US009676509B2

(12) United States Patent
Shin et al.

(10) Patent No.: US 9,676,509 B2
(45) Date of Patent: Jun. 13, 2017

(54) TRAY FOR TRANSFERRING PANEL

(71) Applicant: Samsung Display Co., Ltd., Yongin, Gyeonggi-Do (KR)

(72) Inventors: Sang-Kyo Shin, Asan-si (KR); Seung-Gyu Ko, Suwon-si (KR); Heung-Seok Kim, Yongin-si (KR); Kyung-Hwan Jung, Asan-si (KR); Jin-Wook Cho, Gyeongsan-si (KR)

(73) Assignee: Samsung Display Co., Ltd. (KR)

( * ) Notice: Subject to any disclaimer, the term of this patent is extended or adjusted under 35 U.S.C. 154(b) by 309 days.

(21) Appl. No.: 14/261,241

(22) Filed: Apr. 24, 2014

(65) Prior Publication Data

US 2015/0151870 A1 Jun. 4, 2015

(30) Foreign Application Priority Data

Nov. 29, 2013 (KR) ..... 10-2013-0147429

(51) Int. Cl.
*B65D 85/48* (2006.01)
*B65D 1/34* (2006.01)
*B65D 81/133* (2006.01)

(52) U.S. Cl.
CPC ..... *B65D 1/34* (2013.01); *B65D 81/133* (2013.01); *B65D 85/48* (2013.01)

(58) Field of Classification Search
CPC ..... B65D 1/34; B65D 85/48; B65D 81/133
USPC ..... 206/204, 453–455, 521, 523, 586, 591, 206/592, 557, 560, 562, 564, 565, 449
See application file for complete search history.

(56) References Cited

U.S. PATENT DOCUMENTS 3,701,465 A * 10/1972 Richter ..... B65D 81/056 206/521
4,767,984 A * 8/1988 Bakker ..... H05K 7/1023 206/724
7,571,808 B2 8/2009 Kong et al.
7,644,820 B2 * 1/2010 Hohne ..... B65D 81/053 206/449
8,176,697 B1 5/2012 Bolander, II
(Continued)

FOREIGN PATENT DOCUMENTS

KR 1020050033944 A 4/2005
KR 1020070013618 A 1/2007
(Continued)

*Primary Examiner* — Luan K Bui
(74) *Attorney, Agent, or Firm* — Innovation Counsel LLP

(57) ABSTRACT

A tray for transferring a panel is disclosed. The tray includes a tray mold frame including acrylonitrile-butadiene-styrene ("ABS") resin, a receiving member, a supporting member and a slot member. The tray mold frame includes four extrusion bars and four molding members. The molding members combine with the extrusion bars. Each of the molding members include a first protruding part on a side surface. The receiving member is disposed inside of the tray mold frame. The supporting member is disposed on a lower surface of the receiving member. The supporting member combines with the extrusion bars configured to support the receiving member. The slot member includes a first groove combining with the first protruding part. The slot member is disposed on the receiving member. Thus, when the panel is transferred by the tray, a fault of the panel during transferring may decrease.

17 Claims, 4 Drawing Sheets

(56) References Cited

U.S. PATENT DOCUMENTS

| | | | | |
|---|---|---|---|---|
| 2007/0193891 | A1* | 8/2007 | Portier | B65D 81/266 206/204 |
| 2008/0128310 | A1* | 6/2008 | Kao | B65D 81/107 206/521 |
| 2011/0073519 | A1* | 3/2011 | Davis, II | G09F 5/02 206/562 |
| 2013/0270139 | A1* | 10/2013 | Chen | B65D 81/05 206/453 |
| 2013/0306514 | A1* | 11/2013 | Hu | B65D 81/053 206/586 |
| 2014/0097121 | A1* | 4/2014 | Chen | B65D 85/48 206/586 |
| 2014/0202909 | A1* | 7/2014 | Kuo | B65D 85/48 206/453 |

FOREIGN PATENT DOCUMENTS

| | | | |
|---|---|---|---|
| KR | 100790425 | B1 | 12/2007 |
| KR | 1020080048259 | A | 6/2008 |
| KR | 1020130063852 | A | 6/2013 |

* cited by examiner

TRAY FOR TRANSFERRING PANEL

This application claims priority to Korean Patent Application No. 10-2013-0147429, filed on Nov. 29, 2013, and all the benefits accruing therefrom under 35 U.S.C. §119, the content of which are incorporated by reference herein in its entirety.

BACKGROUND

1. Field

Exemplary embodiments relate to a tray for transferring a panel. More particularly, exemplary embodiments relate to a tray capable of preventing a fault during transferring a panel.

2. Description of the Related Art

A liquid crystal display ("LCD") apparatus applies voltages to molecules of liquid crystal to convert arrangements of the molecules and change optical characteristics of the liquid crystal cell such as birefringence, optical activity, dichroism and light scattering, for example, to display an image.

Generally, the LCD apparatus includes a liquid crystal display panel and a backlight assembly. The liquid crystal display panel displays an image by controlling a light transmittance of the liquid crystal. The backlight assembly is typically disposed on a lower surface of the LCD panel and provides light to the LCD panel. The backlight assembly typically generates non-polarized light.

The liquid crystal display panel includes two substrates and the substrates typically are formed in a glass, so that the substrates may be easily broken by movements and impacts. Thus, the liquid crystal panel may be received in a tray having a space to transfer. A plurality of the trays may be stacked and then the trays packed in a container.

Generally, the tray is formed in styrofoam, such as expanded polystyrene ("EPS"), expanded polypropylene ("EPP"), etc. However, the tray has a low impact resistance.

The tray may be formed in an injection molding method, so that the tray may be difficult to apply with various sizes of display panel. Furthermore, molds for manufacturing the trays corresponding to each sizes of display panel may be manufactured, so that a manufacture cost may increase.

Generally, a slot member may be disposed on an inner edge of the tray to prevent a movement of the liquid crystal display panel. However, the slot member may be not fixed on the tray, so that the tray may be easily broken.

A printed circuit board assembly ("PBA") may be disposed on a side of the liquid crystal display panel configured to drive the liquid crystal display panel. When the slot member is not fixed on the tray, a TAP (Drive)-IC chip connected to the PBA may be wrinkled.

SUMMARY

Exemplary embodiments provide a tray for transferring a panel capable of preventing a fault during transferring the panel.

In accordance with an exemplary embodiment, a tray for transferring a panel includes a tray mold frame including acrylonitrile-butadiene-styrene ("ABS") resin, a receiving member, a supporting member and a slot member. The tray mold frame includes four extrusion bars and four molding members combining with the extrusion bars. Each of the molding members includes a first protruding part on a side surface. The receiving member is disposed inside the tray mold frame. The supporting member is disposed on a lower surface of the receiving member, combining with the extrusion bars and configured to support the receiving member. The slot member includes a first groove combining with the first protruding part and disposed on the receiving member.

In an exemplary embodiment, the extrusion bars may include combining holes for combining with the molding members in both sides of the extrusion bars.

In an exemplary embodiment, the molding members may include injecting parts disposed in both sides of the molding members, the injection parts being in the combining holes.

In an exemplary embodiment, the slot member may include a second protruding part.

In an exemplary embodiment, the molding member may include a second groove combining with the second protruding part to prevent a movement of the slot member.

In an exemplary embodiment, the second groove and the second protruding part may be quadrangle.

In an exemplary embodiment, the tray may further include an absorption member disposed inside the tray mold frame and may be adjacent to the extrusion bars.

In an exemplary embodiment, the absorption member may include silica gel.

In an exemplary embodiment, the molding members may have an L shape.

In an exemplary embodiment, the first protruding part may have a cylindrical shape.

In an exemplary embodiment, the first groove may have a cylindrical-shaped groove corresponding to the first protruding part.

In an exemplary embodiment, the slot member may further include a fixing member configured to prevent a movement of the panel.

In an exemplary embodiment, the slot member may further include a letter marking part marked on a side surface of the slot member.

In an exemplary embodiment, the tray mold frame may be quadrangle.

In an exemplary embodiment, the receiving member may include a corrugated cardboard.

In an exemplary embodiment, the corrugated cardboard may be multi-layered.

In an exemplary embodiment, the corrugated cardboard may include single faced corrugated cardboard, double faced corrugated cardboard, double wall corrugated cardboard and triple wall corrugated cardboard.

In an exemplary embodiment, the supporting member may include the ABS resin.

In such embodiments, the tray for transferring the panel may prevent a fault during transferring the panel.

The tray may be formed in an extrusion method and an injection molding method, so that the tray may be easily applied to various sizes of panel. Strength and impact resistance of the tray may be improved. The tray may fix the panel, thereby preventing a movement of the panel.

BRIEF DESCRIPTION OF THE DRAWINGS

The disclosure will become more apparent by describing in detailed exemplary embodiments thereof with reference to the accompanying drawings, in which.

DETAILED DESCRIPTION

Hereinafter, exemplary embodiments will be described in detail with reference to the accompanying drawings.

Figure 1:
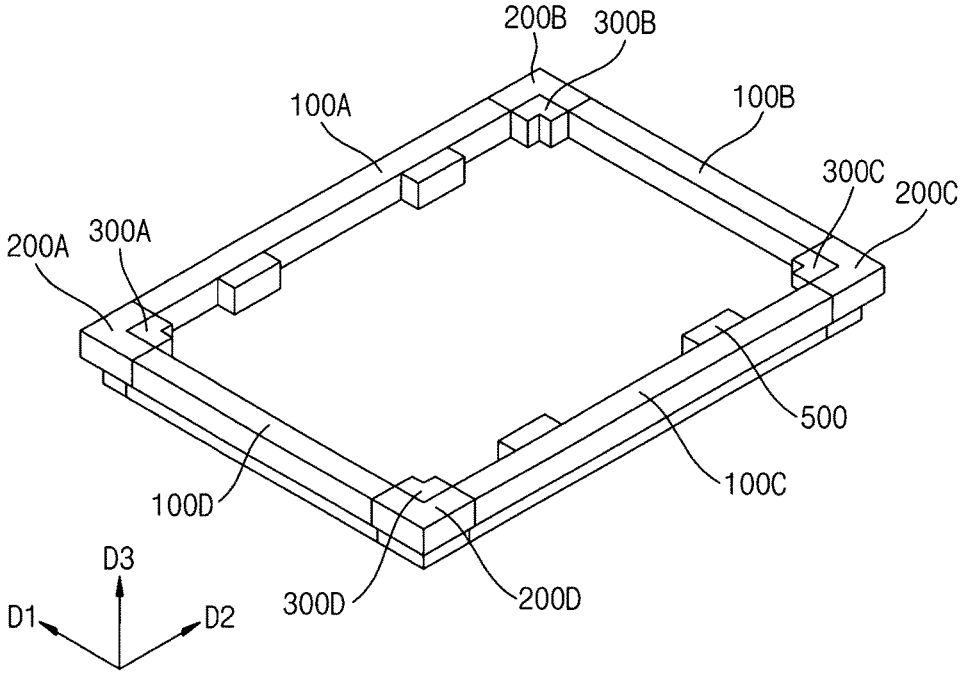
FIG. 1 is an upper perspective view illustrating an exemplary embodiment of a tray for transferring a panel.
Figure 2:
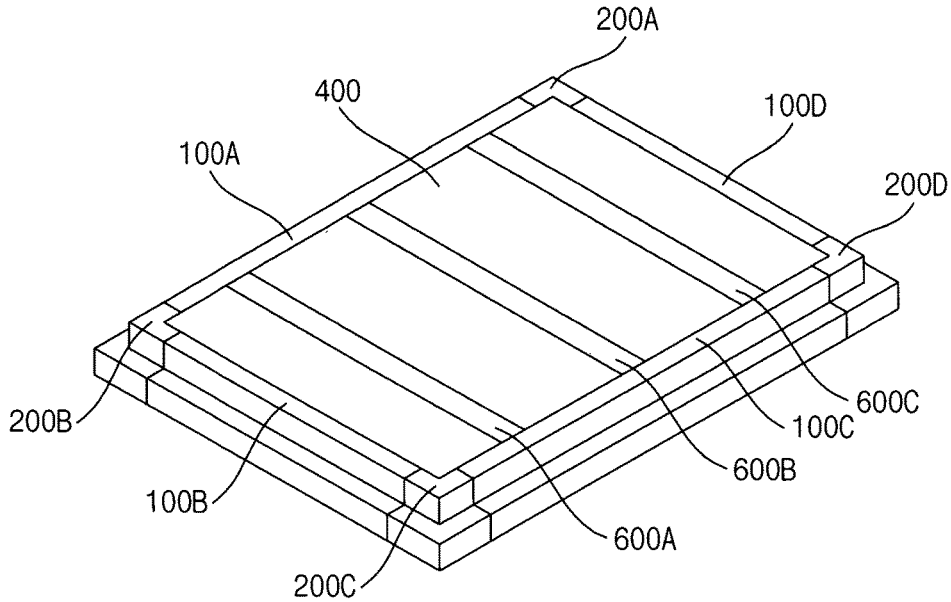
FIG. 2 is a lower perspective view illustrating an exemplary embodiment of a tray for transferring a panel.

FIG. 1 is an upper perspective view illustrating an exemplary embodiment of a tray for transferring a panel. FIG. 2 is a lower perspective view illustrating an exemplary embodiment of a tray for transferring a panel.

Referring to FIGS. 1 and 2, an exemplary embodiment of a tray includes a tray mold frame including extrusion bars and molding members, slot members, a receiving member, absorption members and supporting members.

The tray mold frame may includes four extrusion bars 100A, 100B, 100C, 100D and four molding members 200A, 200B, 200C, 200D.

The extrusion bars 100A, 100B, 100C, 100D may be formed in an extrusion method. The extrusion bars 100A, 100B, 100C, 100D may include an acrylonitrile-butadiene-styrene ("ABS") resin.

The ABS resin may include acrylonitrile, butadiene and styrene. The ABS resin has excellent properties, such as impact resistance, chemical resistance and durability. Furthermore, the ABS resin has an excellent workability for an extrusion method and an injection molding method.

The molding members 200A, 200B, 200C, 200D may be formed in an injection molding method. The molding members 200A, 200B, 200C, 200D may include the ABS resin.

Each of the molding members 200A, 200B, 200C, 200D may be disposed in both sides of the extrusion bars 100A, 100B, 100C, 100D. The molding members 200A, 200B, 200C, 200D may combine with the extrusion bars 100A, 100B, 100C, 100D. Each of the molding members 200A, 200B, 200C, 200D may include a first protruding part on a side surface.

A structure of the extrusion bars 100A, 100B, 100C, 100D and molding members 200A, 200B, 200C, 200D will be described in detail.

The tray mold frame including the extrusion bars 100A, 100B, 100C, 100D and the molding members 200A, 200B, 200C, 200D may be quadrangle.

The extrusion bars 100A, 100B, 100C, 100D may consist, e.g., form, four sides of the tray mold frame.

The molding members 200A, 200B, 200C, 200D may be disposed on edges, e.g., corners, of the quadrangle. The molding members 200A, 200B, 200C, 200D may have an L shape. The molding members 200A, 200B, 200C, 200D may combine with the extrusion bars 100A, 100B, 100C, 100D.

The slot members 300A, 300B, 300C, 300D, sometimes called slots, may include a first groove combining with the first protruding part. The slot members 300A, 300B, 300C, 300D may include a fixing member configured to prevent a movement of the panel. The slot members 300A, 300B, 300C, 300D may be disposed on the receiving member 400. The slot members 300A, 300B, 300C, 300D may have an L shape.

A structure of the slot members 300A, 300B, 300C, 300D will be described in detail.

The receiving member 400 may be disposed inside the tray mold frame. The panel may be received on an upper surface of the receiving member 400.

The receiving member 400 may protect the panel from impact. Thus, the receiving member 400 may be formed in a material having an excellent impact resistance.

For example, the receiving member 400 may include a corrugated cardboard.

The impact resistance of the receiving member 400 may be controlled by a height of a corrugation and a number of the corrugation.

The corrugated cardboard may be multi-layered. For example, the corrugated cardboard may be single faced corrugated cardboard, double faced corrugated cardboard, double wall corrugated cardboard and triple wall corrugated cardboard or the like.

The absorption member 500 may be disposed inside the tray mold frame. The absorption member 500 may be adjacent to the extrusion bars 100A, 100B, 100C, 100D.

The absorption member 500 may absorb moisture existing in the tray mold frame. Thus, the absorption member 500 may prevent a fault of the panel by the moisture. For example, the absorption member 500 may include silica gel.

The supporting member 600A, 600B, 600C may be disposed at a lower surface of the receiving member 400. The supporting member 600A, 600B, 600C may combine with the extrusion bars 100A, 100B, 100C, 100D.

The supporting member 600A, 600B, 600C may support the receiving member 400.

The supporting member 600A, 600B, 600C may be formed in an extrusion method. The supporting member 600A, 600B, 600C may include the ABS resin.

A number of the supporting member 600A, 600B, 600C may be two to ten. When the number of the supporting member 600A, 600B, 600C is minimized, a manufacturing cost may decrease. When the number of the supporting member 600A, 600B, 600C is less than two, the supporting member 600A, 600B, 600C may be difficult to support a weight of the panel disposed thereon. When the number of the supporting member 600A, 600B, 600C is more than ten, a manufacturing cost of the tray may increase. The number of the supporting member 600A, 600B, 600C may be modified appropriately in accordance with a weight and a number of the panel disposed thereon.

Figure 3:
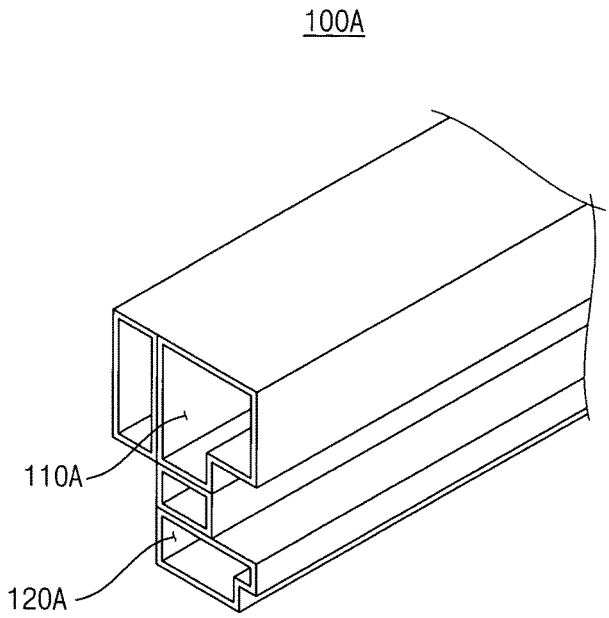
FIG. 3 is a perspective view illustrating an exemplary embodiment of an extrusion bar.
Figure 4A:
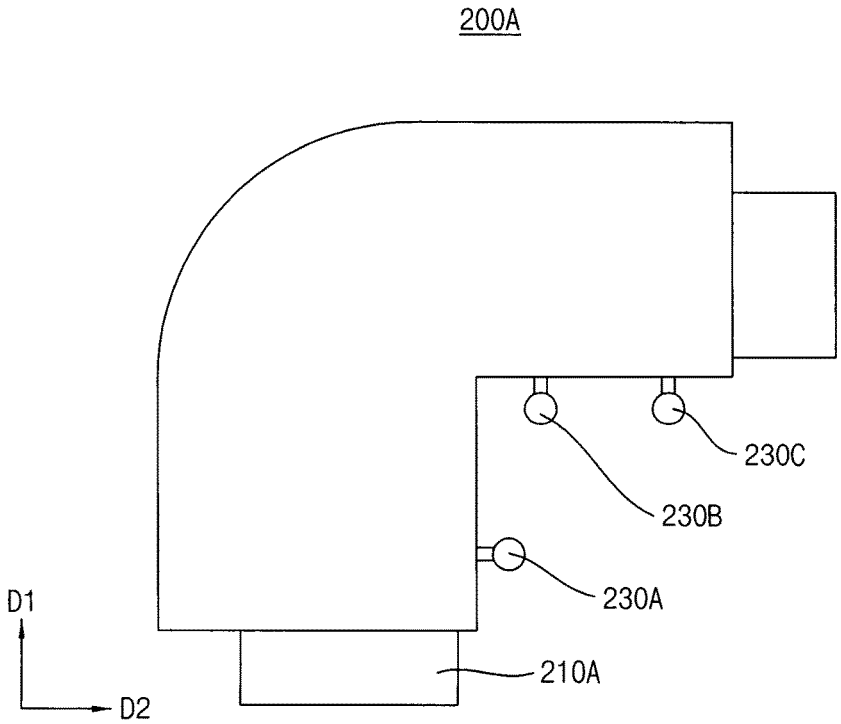
FIG. 4A is a plan view illustrating an exemplary embodiment of a molding member.
Figure 4B:
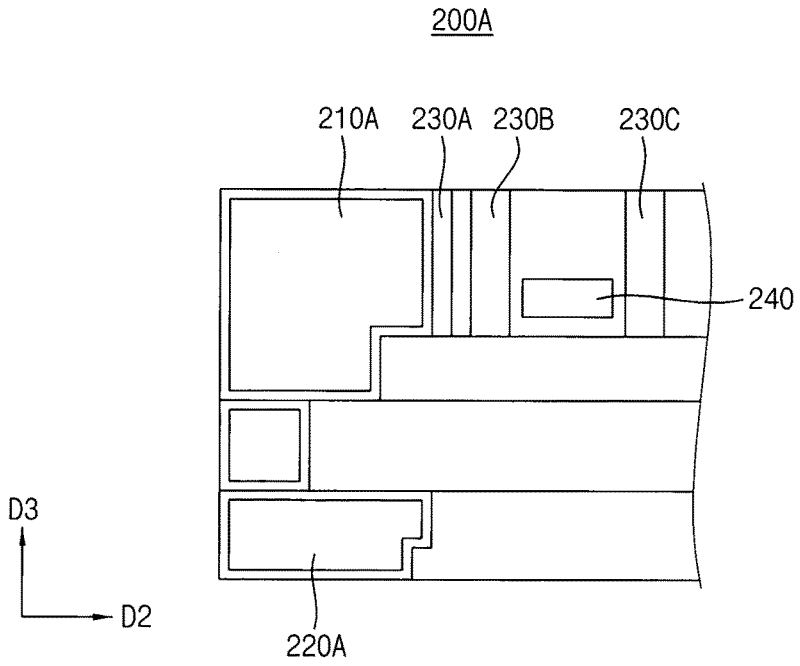
FIG. 4B is a front view illustrating an exemplary embodiment of a molding member.
Figure 5A:
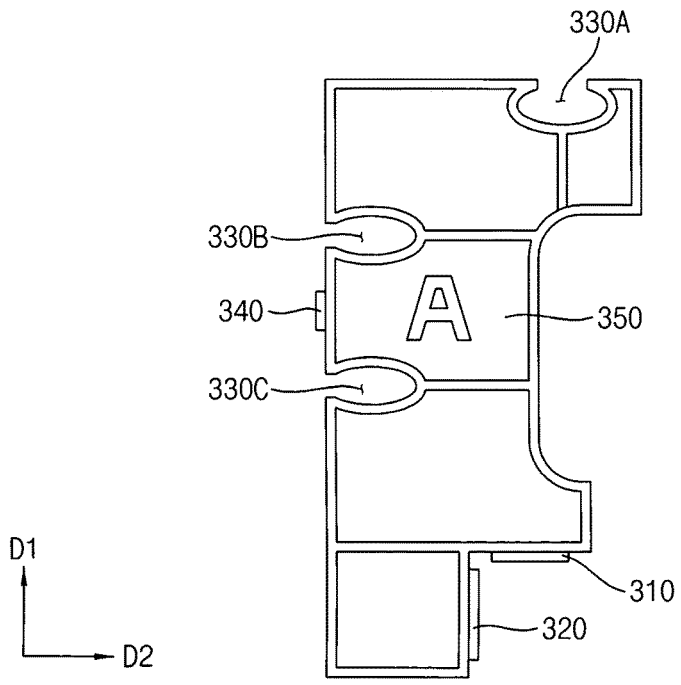
FIG. 5A is a plan view illustrating an exemplary embodiment of a slot member.
Figure 5B:
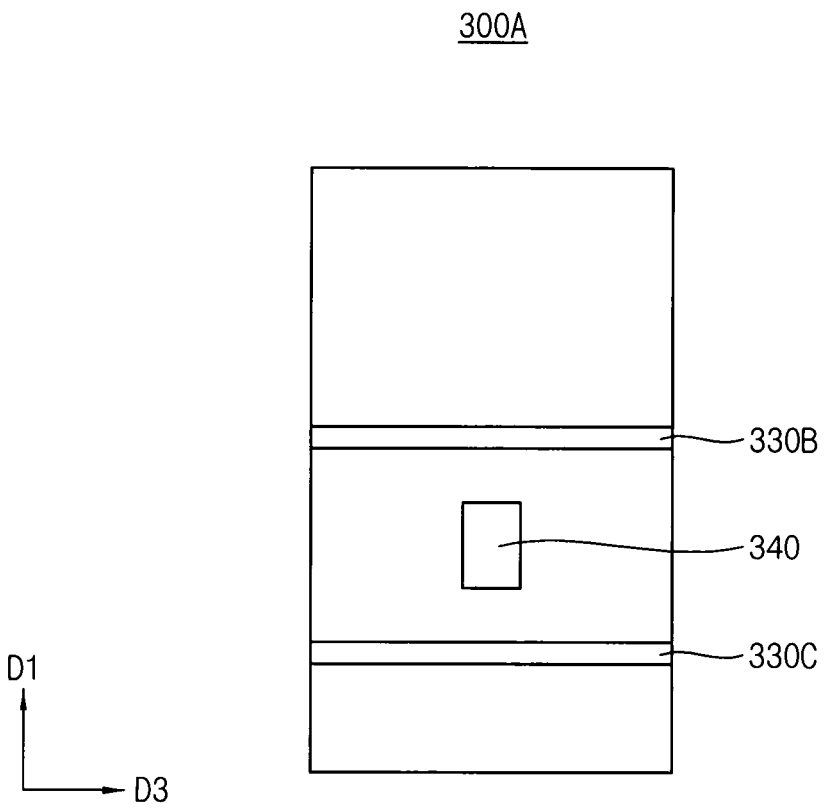
FIG. 5B is a side view illustrating an exemplary embodiment of a slot member.

FIG. 3 is a perspective view illustrating an exemplary embodiment of the extrusion bar 100A. FIG. 4A is a plan view illustrating an exemplary embodiment of the molding member 200A. FIG. 4B is a front view illustrating an exemplary embodiment of the molding member 200A. FIG. 5A is a plan view illustrating an exemplary embodiment of the slot member 300A. FIG. 5B is a side view illustrating an exemplary embodiment of the slot member 300A. Although the extrusion bar 100A, the molding member 200A, and the slot member 300A are illustrated in FIGS. 3, 4A, 4B, 5A, 5B, the discussion and illustrations are generally applicable to the extrusion bars 100A, 100B, 100C, 100D, the molding members 200A, 200B, 200C, 200D, and the slot members 300A, 300B, 300D, 300D, respectively.

Referring to FIGS. 1 to 3, the extrusion bars 100A, 100B, 100C, 100D may include a combining hole.

The combining hole may include a first combining hole 110A and a second combining hole 120A.

The first combining hole 110A and the second combining hole 120A may be formed in both sides of the extrusion bars 100A, 100B, 100C, 100D.

The extrusion bars 100A, 100B, 100C, 100D may be formed in an extrusion method.

Generally, an extrusion molding product may easily collapse when a molding material passes through a mold, because the molding material is not hardened yet. Thus, an extrusion molding product may have a space therein. The combining hole and another hole of the extrusion bars 100A, 100B, 100C, 100D may have various shapes.

The extrusion bars 100A, 100B, 100C, 100D may include the ABS resin.

Referring to FIGS. 1 to 5B, the tray for transferring the panel may include the molding members 200A, 200B, 200C, 200D and the slot members 300A, 300B, 300C, 300D.

The molding members 200A, 200B, 200C, 200D and the slot members 300A, 300B, 300C, 300D may be framed in an injection molding method. Thus, a mold may be formed, and then the molding members 200A, 200B, 200C, 200D and the slot members 300A, 300B, 300C, 300D may be formed by the mold.

Each of the molding members 200A, 200B, 200C, 200D may be disposed in both sides of the extrusion bars 100A, 100B, 100C, 100D. The molding members 200A, 200B, 200C, 200D may combine with the extrusion bars 100A, 100B, 100C, 100D.

The tray mold frame including the extrusion bars 100A, 100B, 100C, 100D and the molding members 200A, 200B, 200C, 200D may be quadrangle.

The molding members 200A, 200B, 200C, 200D may be disposed on edges of the quadrangle. The molding members 200A, 200B, 200C, 200D may have an L shape. The molding members 200A, 200B, 200C, 200D may combine with the extrusion bars 100A, 100B, 100C, 100D.

The molding members 200A, 200B, 200C, 200D may include an injecting part disposed in both sides of the molding members 200A, 200B, 200C, 200D. The injecting part may be inserted into the combining hole of the extrusion bars 100A, 100B, 100C, 100D.

For example, the injecting part may include a first injecting part 210A and a second injecting part 220A. The first injecting part 210A may be corresponding to the first combining hole 110A. The first injecting part 210A may be formed configured to inject to the first combining hole 110A. The second injecting part 220A may be corresponding to the second combining hole 120A. The second injecting part 220A may be formed configured to inject to the second combining hole 120A.

The molding members 200A, 200B, 200C, 200D may include the ABS resin.

The molding members 200A, 200B, 200C, 200D may include a first protruding part 230A, 230B, 230C configured to prevent a two-dimensional movement of the slot members 300A, 300B, 300C, 300D. The slot members 300A, 300B, 300C, 300D may include a first groove 330A, 330B, 330C combining with the first protruding part 230A, 230B, 230C.

The first protruding part 230A, 230B, 230C may be disposed on a side surface of the molding members 200A, 200B, 200C, 200D. The first protruding part 230A, 230B, 230C may be disposed along a first direction D1 and a second direction D2, which is perpendicular to the first direction D1. The first protruding part 230A, which is disposed along the first direction D1, may prevent a movement of the panel along the first direction D1. The second protruding part 230B, 230C, which is disposed along the second direction D2, may prevent a movement of the panel along the second direction D2.

The first protruding part 230A, 230B, 230C may have a cylindrical shape. The first groove 330A, 330B, 330C may have a cylindrical-shaped groove corresponding to the first protruding part 230A, 230B, 230C. Thus, the first protruding part 230A, 230B, 230C may easily combine with the first groove 330A, 330B, 330C by a cylindrical shape. Therefore, a durability of the molding member 200A, 200B, 200C, 200D and the slot members 300A, 300B, 300C, 300D may increase.

The slot members 300A, 300B, 300C, 300D may further include a second protruding part 340 configured to prevent a three-dimensional movement of the slot members 300A, 300B, 300C, 300D. The molding member 200A, 200B, 200C, 200D may further include a second groove 240 combining with the second protruding part 340.

The second protruding part 340 and the second groove 240 may combine with each other, thereby preventing the two-dimensional and the three-dimensional movements of the slot members 300A, 300B, 300C, 300D.

The second protruding part 340 may be injected to the second groove 240, so that the second protruding part 340 and the second groove 240 may be fixed.

The second protruding part 340 and the second groove 240 may have a same shape, thereby interlocking the second protruding part 340 with the second groove 240. For example, the second protruding part 340 and the second groove 240 may have quadrangle. Alternatively, the second protruding part 340 and the second groove 240 may have various shapes.

The slot members 300A, 300B, 300C, 300D may have an L shape, which is similar to the molding member 200A, 200B, 200C, 200D. Thus, the slot members 300A, 300B, 300C, 300D may be fixed to an edge of the molding member 200A, 200B, 200C, 200D.

The slot members 300A, 300B, 300C, 300D may be formed in various sizes and shapes. The sizes and shapes of the slot members 300A, 300B, 300C, 300D may be modified in accordance with a size of the panel disposing on the tray.

Thus, the first protruding part 230A, 230B, 230C and the first groove 330A, 330B, 330C may combine with each other configured to prevent the two-dimensional and the three-dimensional movements of the slot members 300A, 300B, 300C, 300D.

The slot members 300A, 300B, 300C, 300D may further include a fixing member to prevent a movement of the panel.

For example, the fixing member may include a first fixing member 310 and a second fixing member 320. The first fixing member 310 may prevent a movement of the panel along the first direction D1. The second fixing member 320 may prevent a movement of the panel along the second direction D2.

The fixing member may contact with the panel. The fixing member may be formed of a material, which has an excellent elasticity and an excellent friction, thereby preventing a movement of the panel. For example, the fixing member may include rubber.

The slot members 300A, 300B, 300C, 300D may further include a letter marking part 350. The letter marking part 350 may be marked on a side surface of the slot members 300A, 300B, 300C, 300D.

The letter marking part 350 may be an alphabet or the like. The letter marking part 350 may be embossed or engraved. The letter marking part 350 may be formed during an extrusion process of the slot members 300A, 300B, 300C, 300D. Alternatively, the slot members 300A, 300B, 300C, 300D are formed and then the letter marking part 350 may be formed.

The slot members 300A, 300B, 300C, 300D may include the letter marking part 350, so that a misuse of various sizes of the slot members 300A, 300B, 300C, 300D may be prevented. Thus, a fault of the panel may decrease.

Although exemplary embodiments have been described, it is understood that the inventive concept should not be limited to these exemplary embodiments and various changes and modifications can be made by one of those ordinary skilled in the art in the spirit and scope as hereinafter claimed.

What is claimed is:

1. A tray for transferring a panel, comprising:

a tray mold frame including acrylonitrile-butadiene-styrene resin, the tray mold frame comprising:

four extrusion bars; and four molding members combining with the extrusion bars, wherein each of the extrusion bars comprises combining holes for combining with the molding members at each end of each of the extrusion bars, each of the molding members comprising a first protruding part on a side surface;

a receiving member disposed inside the tray mold frame;

a supporting member disposed on a lower surface of the receiving member, combining with the extrusion bars and supporting the receiving member; and a slot member comprising a first groove combining with the first protruding part and disposed on the receiving member.

2. The tray of claim 1, wherein the molding members comprise injecting parts disposed in both sides of the molding members, the injection parts being in the combining holes.

3. The tray of claim 1, wherein the slot member comprises a second protruding part.

4. The tray of claim 3, wherein the molding members comprise a second groove combining with the second protruding part to prevent a movement of the slot member.

5. The tray of claim 4, wherein the second groove and the second protruding part are quadrangle.

6. The tray of claim 1, further comprising:

an absorption member disposed inside the tray mold frame and adjacent to the extrusion bars.

7. The tray of claim 6, wherein the absorption member comprises silica gel.

8. The tray of claim 1, wherein the molding members have an L shape.

9. The tray of claim 1, wherein the first protruding part has a cylindrical shape.

10. The tray of claim 9, wherein the first groove has a cylindrical-shaped groove corresponding to the first protruding part.

11. The tray of claim 1, wherein the slot member further comprises a fixing member configured to prevent a movement of the panel.

12. The tray of claim 1, wherein the slot member further comprises a letter marking part marked on a side surface of the slot member.

13. The tray of claim 1, wherein the tray mold frame is quadrangle.

14. The tray of claim 1, wherein the receiving member comprises a corrugated cardboard.

15. The tray of claim 14, wherein the corrugated cardboard is multi-layered.

16. The tray of claim 15, wherein the corrugated cardboard comprises one selected from the group consisting of single faced corrugated cardboard, double faced corrugated cardboard, double wall corrugated cardboard and triple wall corrugated cardboard.

17. The tray of claim 1, wherein the supporting member comprises the acrylonitrile-butadiene-styrene resin.

* * * * *